US006102669A

United States Patent [19]

Fujita

[11] Patent Number: 6,102,669

[45] Date of Patent: Aug. 15, 2000

[54] VARIABLE DISPLACEMENT COMPRESSOR

[75] Inventor: Masaaki Fujita, Isesaki, Japan

[73] Assignee: Sanden Corporation, Gunma, Japan

[21] Appl. No.: 09/120,127

[22] Filed: Jul. 22, 1998

[30] Foreign Application Priority Data

Aug. 8, 1997 [JP] Japan ..... 9-214517

[51] Int. Cl.[7] ..... F04B 1/26

[52] U.S. Cl. ..... 417/222.2; 417/222; 417/222.1

[58] Field of Search ..... 417/222, 222.2, 417/269, 270, 222.1; 92/12.2

[56] References Cited

U.S. PATENT DOCUMENTS

| | | | |
|---|---|---|---|
| 4,480,964 | 11/1984 | Skinner | 417/222 |
| 4,664,604 | 5/1987 | Terauchi . | |
| 4,685,866 | 8/1987 | Takenaka et al. | 417/222 |
| 4,729,718 | 3/1988 | Ohta et al. . | |
| 4,729,719 | 3/1988 | Kayukawa et al. . | |
| 4,801,248 | 1/1989 | Tojo et al. | 417/222 |
| 4,815,358 | 3/1989 | Smith | 92/12.2 |
| 4,865,523 | 9/1989 | Kikuchi et al. . | |
| 5,282,725 | 2/1994 | Shimizu . | |
| 5,397,218 | 3/1995 | Fujii et al. | 417/269 |
| 5,584,670 | 12/1996 | Kawaguchi et al. . | |
| 5,624,240 | 4/1997 | Kawaguchi et al. | 417/222.2 |

FOREIGN PATENT DOCUMENTS 0536989 4/1993 European Pat. Off. .

05099136 4/1993 Japan .

*Primary Examiner*—Teresa Walberg
*Assistant Examiner*—L Fastovsky
*Attorney, Agent, or Firm*—Baker Botts L.L.P.

[57] ABSTRACT

A vehicular air conditioning refrigerant compressor is disclosed. The variable displacement compressor includes a suction chamber, a discharge chamber, a crank chamber, a drive shaft having rotated by a vehicle engine, a swash plate rotatable with the drive shaft and located within the crank chamber. The swash plate and the drive shaft have a tilt angle between them. The tilt angle is controlled by a control valve mechanism which regulates the introduction of a gas from the discharge chamber to the crank chamber. The compressor further includes a center sleeve slidably mounted on the drive shaft. The position of the center sleeve is responsive to the tilt angle. The compressor also includes a relief passage for relieving gas from the crank chamber to the suction chamber, and includes an axial hole in the drive shaft having an opening at one end of the drive shaft and an end within the drive shaft, a vertical hole in the drive shaft having two openings on the surface of the drive shaft and perpendicular to said axial hole. The vertical hole intersects the axial hole near the end of the axial hole. The relief passage further includes a passage in fluid connection with the suction chamber and the opening of the axial hole. The aperture of the two openings is regulated by the position of the center sleeve.

8 Claims, 5 Drawing Sheets

VARIABLE DISPLACEMENT COMPRESSOR

BACKGROUND OF THE INVENTION

1. Field of the Invention

The present invention relates to a refrigerant compressor for use in a vehicular air conditioning system. More particularly, it relates to a swash plate-type compressor having an improved capacity control response.

2. Description of the Related Art

Referring to FIG. 1, a known swash plate-type variable displacement compressor 50' is provided. One such swash plate-type variable displacement compressor is disclosed in Japanese Patent Publication Hei 4-74549. The shell of compressor 50 ' comprises front housing 8, cylinder block 1, valve plate 2, and rear housing 3. These parts are fixed together by a plurality of bolts 5. Drive shaft 10 extends along the main axis of the compressor 50'. A part of drive shaft 10 is rotatably supported by the front housing 8 through needle bearing 11'. Another part of drive shaft 10 is also rotatably supported by cylinder block 1 through needle bearing 11. Within compressor 50', crank chamber 9 is provided to accommodate rotor 17 and swash plate 19. Rotor 17 is fixed to drive shaft 10 by bolt 14, and rotates together with drive shaft 10. Rotor 17 is coupled to swash plate 19 via variable hinge mechanism 18, so that the tilt angle of swash plate 19 with respect to drive shaft 10 may be changed. Swash plate 19 is connected to center sleeve 22' by pins 40, 40' which are provided in an orthogonal direction with drive shaft 10. Center sleeve 22' is slidably mounted on drive shaft 10 in the axial direction of drive shaft 10. The relative angle between swash plate 19 and center sleeve 22' is variable. Through these connections, when drive shaft 10 rotates, rotor 17, swash plate 19, and sleeve 22' rotate with drive shaft 10. Further, when the capacity of the compressor changes, the tilt angle of swash plate 19 with respect to drive shaft 10 changes, causing center sleeve 22' to slide on drive shaft 10.

Axial movement of drive shaft 10 is inhibited by thrust bearing 41 and adjuster screw 42.

Through shoes 20, swash plate 19 is connected to pistons 13, which are slidably accommodated in a plurality of peripherally-located piston bores 12. When swash plate 19, which is tilted with respect to drive shaft 10, rotates, swash plate 19 rotates with a component of wobbling motion. Since the plane bottom surface of shoes 20 slide on the plane surface of swash plate 19, only the wobbling component of the motion of the swash plate 19 is transmitted to piston 13. As a result, when drive shaft 10 rotates, each piston 13 reciprocates within its piston bore 12.

On one face of valve plate 2, suction valve 15 is attached, and on the other face, discharge valve mechanism 16 is attached. Discharge valve mechanism 16 is fixed on valve plate 2 by bolt 44 and nut 45. Bolt accommodating room 26 is provided at the center portion of the cylinder block 1, and accommodates the head part of the bolt 44.

Within the interior of rear housing 3, suction chamber 4, 4', discharge chamber 6, and known control valve mechanism 21, are provided. Suction chamber 4' is in fluid connection with suction chamber 4, relief passage L1, and control valve mechanism through passage L2.

When compressor 50' is driven to rotate, each piston 13 reciprocates in its piston bore 12, and refrigerant gas from an external refrigerant circuit (not shown) is sucked into suction chamber 4, and compressed refrigerant gas is sent to the external refrigerant circuit (e.g., a condenser) via the discharge chamber 6.

The capacity control of compressor 50' is accomplished as follows. Control valve mechanism 21 has a fundamental function of introducing gas from discharge chamber 6 into crank chamber 9. The gas pressure within suction chamber 4' controls the introduction of gas from discharge chamber 6 into crank chamber 9. The gas within discharge chamber 6 is supplied to control valve mechanism 21 via passage L3. The gas supplied from passage L3 is sent by the gas pressure valance to crank chamber 9 through a control valve (not shown) within control valve mechanism 21, and through passage L4. The suction chamber pressure that regulates the control valve within control valve mechanism 21 is supplied from suction chamber 4', via passage L2, to control valve mechanism 21. The gas in crank chamber 9 exits to suction chamber 4', via relief passage L1.

Thus, the refrigerant gas pressure within crank chamber 9 is determined by a balance between the incoming gas via passage L4 and the outgoing gas via relief passage L1 to suction chamber 4'. Initially, when the refrigerant system is started, the suction chamber pressure within suction chamber 4' is high. In this condition, the control valve (not shown) within control valve mechanism 21 closes to prohibit the introduction of refrigerant gas to crank chamber 9. As a result, the crank chamber pressure does not increase, and the tilt angle of swash plate 19 with respect to drive shaft 10 increases to its maximum by a known mechanism. In other words, compressor 50' operates with the maximum capacity in the initial condition when air within a vehicle compartment is not cool.

As the air within the vehicular compartment cools, the suction chamber pressure within suction chamber 4' decreases. The control valve within control valve mechanism 21 opens in order to allow the introduction of refrigerant gas from discharge chamber 6, via passage L4, to crank chamber 9. As a consequence, the crank chamber pressure within crank chamber 9 increases to the discharge chamber pressure, so that the tilt angle of swash plate 19 with respect to drive shaft 10 decreases to its minimum (in which swash plate 19 is almost perpendicular to drive shaft 10) by a known mechanism.

For a comfortable air conditioning in a vehicular compartment, it is important to have a capacity-reducing response performance, as explained above. It is also desirable for a variable capacity compressor to reduce its capacity quickly when the air in the compartment has been sufficiently cooled. In other words, it is desirable that the crank chamber pressure increases quickly in order to decrease the tilt angle of swash plate 19, so that it is almost perpendicular to drive shaft 10, when the air in the compartment is sufficiently cooled.

However, in known compressor 50', due to the presence of passage L1 with a fixed aperture, a considerable amount of the refrigerant gas in crank chamber 9 constantly returns to suction chamber 4' via relief passage L1. This constant flow of refrigerant gas decreases the rate of rise of the crank chamber pressure within crank camber 9. In other words, the constant flow of refrigerant gas reduces the rate of decrement in the tilt angle of swash plate 19 with respect to drive shaft 10. Thus, known swash plate-type 5 compressors do not show a rapid capacity-reducing ability.

SUMMARY OF THE INVENTION

Accordingly, it is a technical advantage of the present invention to provide a swash plate-type compressor with improved capacity control response.

The variable displacement compressor includes a suction chamber, a discharge chamber, a crank chamber, a drive shaft having rotated by a vehicle engine, a swash plate rotatable with the drive shaft and located within the crank chamber. The swash plate and the drive shaft have a tilt angle between them. The tilt angle is controlled by a control valve mechanism which regulates the introduction of a gas from the discharge chamber to the crank chamber. The compressor further includes a center sleeve slidably mounted on the drive shaft. The position of the center sleeve is responsive to the tilt angle. The compressor also includes a relief passage for relieving gas from the crank chamber to the suction chamber, and includes an axial hole in the drive shaft having an opening at one end of the drive shaft and an end within the drive shaft, a vertical hole in the drive shaft having two openings on the surface of the drive shaft and perpendicular to said axial hole. The vertical hole intersects the axial hole near the end of the axial hole. The relief passage further includes a passage in fluid connection with the suction chamber and the opening of the axial hole. The aperture of the two openings is regulated by the position of the center sleeve, that is, by the tilt angle of the swash plate with respect to the drive shaft. The aperture of this passage varies from maximum to minimum when the tilt angle of the swash plate goes from maximum to minimum. When the tilt angle of the swash plate decreases due to the introduction of refrigerant gas into the crank chamber, the degree of aperture of this passage also decreases to increase the crank chamber pressure at an increased rate. By this mechanism, the capacity reduction response of the compressor is improved.

Other objects, features, and advantages of this invention will be understood from the following detailed description of preferred embodiments with reference to the drawings.

BRIEF DESCRIPTION OF THE DRAWINGS

FIG. 5(*b*) is a longitudinal cross sectional view of the center sleeve according to the present invention.

FIG. 5(*c*) is a rear view of the center sleeve according to the present invention.

DETAILED DESCRIPTION OF THE INVENTION

Figure 1:
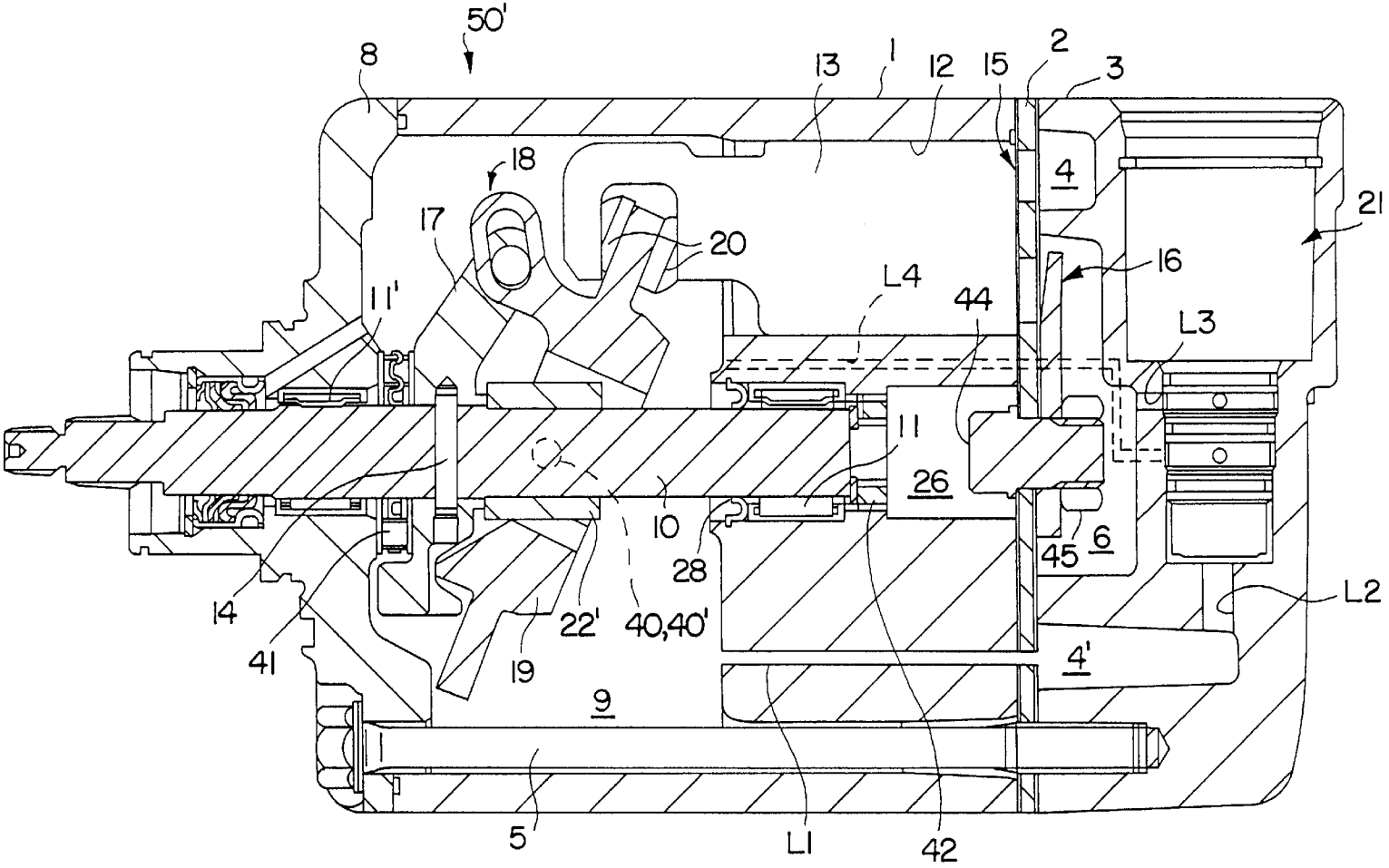
FIG. 1 PRIOR ART
FIG. 1 is a longitudinal cross sectional view of a known swash plate-type compressor.
Figure 2:
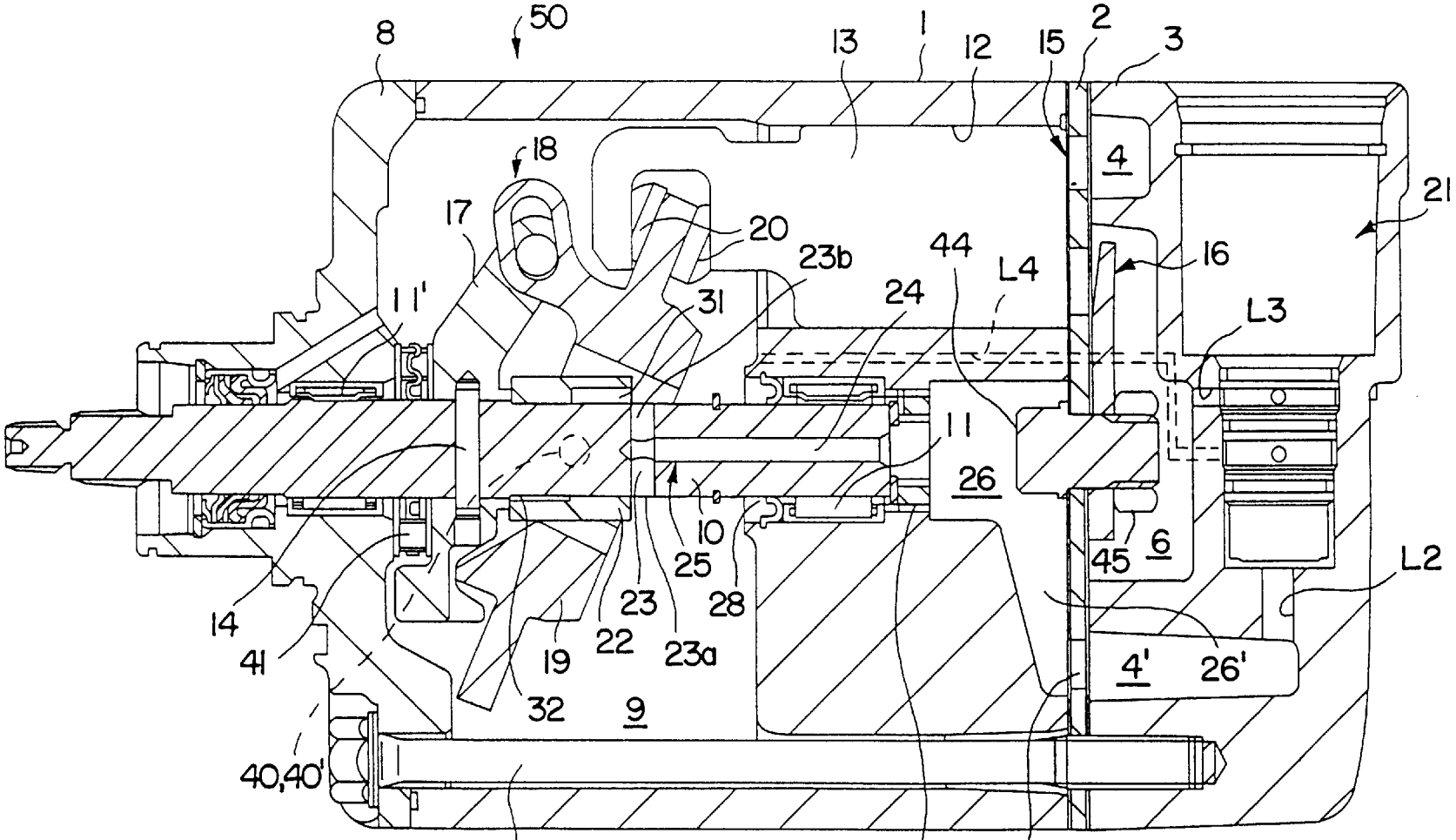
FIG. 2 is a longitudinal cross sectional view of a swash plate-type compressor according to the present invention, in a state of maximum tilt angle.

Referring to FIG. 2, a longitudinal cross section of a swash plate-type compressor 50 according to an embodiment of the present invention is provided. Because like numbers are used to represent the like parts of FIG. 1, an explanation of those parts is omitted.

In drive shaft 10 and along its axis, longitudinal hole 24 is bored from the rear cylinder side end of drive shaft 10, to a point in the general vicinity of swash plate 19. At the end of longitudinal hole 24, vertical hole 23 penetrates drive shaft 10 perpendicularly. Vertical hole 23 is in fluid connection with longitudinal hole 24 at the intersection. The opening at the rear cylinder side end of the drive shaft of longitudinal hole 24 is in fluid connection with bolt accommodating room 26 via the center of adjuster screw 42. Bolt accommodating room 26 is in fluid connection with suction chamber 4' via passage 26' and hole 27 provided in valve plate 2.

Vertical hole 23 is in fluid connection with crank chamber 9 via its two openings 23*a*, 23*b*. The path from vertical hole 23, longitudinal hole 24, bolt accommodating room 26, passage 26', to hole 27, constitutes a relief passage of refrigerant gas from crank chamber 9 to suction chamber 4'. For convenience, vertical hole 23 and longitudinal hole 24 are hereinafter referred to together as hole 25.

Figure 5C:
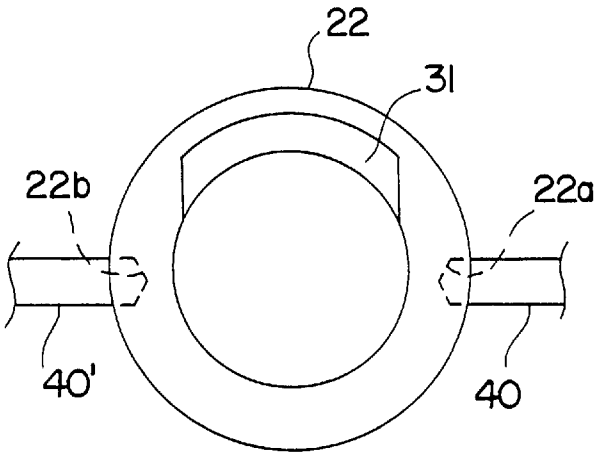
FIG. 5(*a*) is a front view of the center sleeve according to the present invention.
Figure 5B:
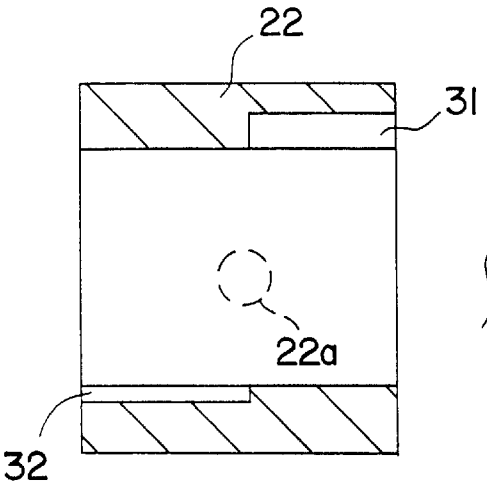
Figure 5A:
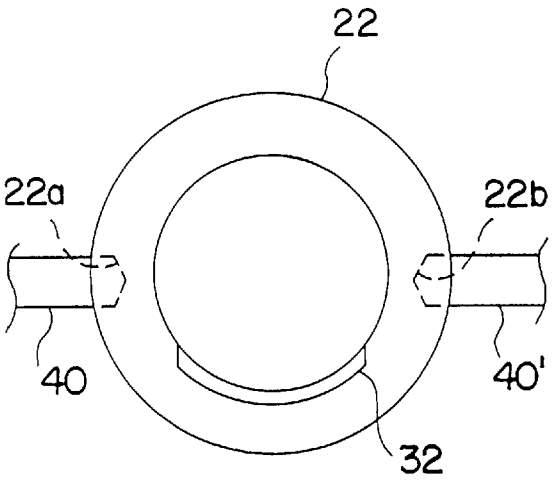

Referring to FIG. 5, center sleeve 22 according to the present invention has a generally hollow cylindrical shape with wall of certain thickness. Pins 40 and 40' are engaged in two holes 22*a* and 22*b* on the outer surface of center sleeve 22. Pins 40, 40' connect swash plate 19 (not shown in FIG. 5(*a*)) and center sleeve 22 so as to enable the relative rotation of them around the axis of pins 40, 40'.

Referring to FIG. 5(*b*), upper groove 31 is cut from the rear cylinder side (right side in the figure) inner surface of the wall of the center sleeve 22. Lower groove 32, which is relatively shallower than upper groove 31, may be cut from the diagonally opposite position with respect to upper groove 31.

Referring again to FIG. 2, when the tilt angle of swash plate 19 decreases from the state shown in FIG. 2, swash plate 19 pulls center sleeve 22 through pins 40, 40', to the right in the figure, to allow center sleeve 22 to slide on drive shaft 10. When the tilt angle of swash plate 19 increases from the minimum tilt angle state, swash plate 19 allows center sleeve 22 slide on drive shaft 10 to the left.

When center sleeve 22 slides to the right on drive shaft 10, center sleeve 22 covers opening 23*a* and 23*b*. Due to the presence of upper and lower grooves 31 and 32 on center sleeve 22, the degree of aperture of openings 23*a* and 23*b* varies continuously. Thus, the position of center sleeve 22 regulates the degree of aperture of openings 23*a* and 23*b* which are the entrance to relief passage 25-26-26'-27. In short, the degree of the aperture of relief passage 25-26-26'-27 is controlled by the tilt angle of swash plate 19.

Figure 3:
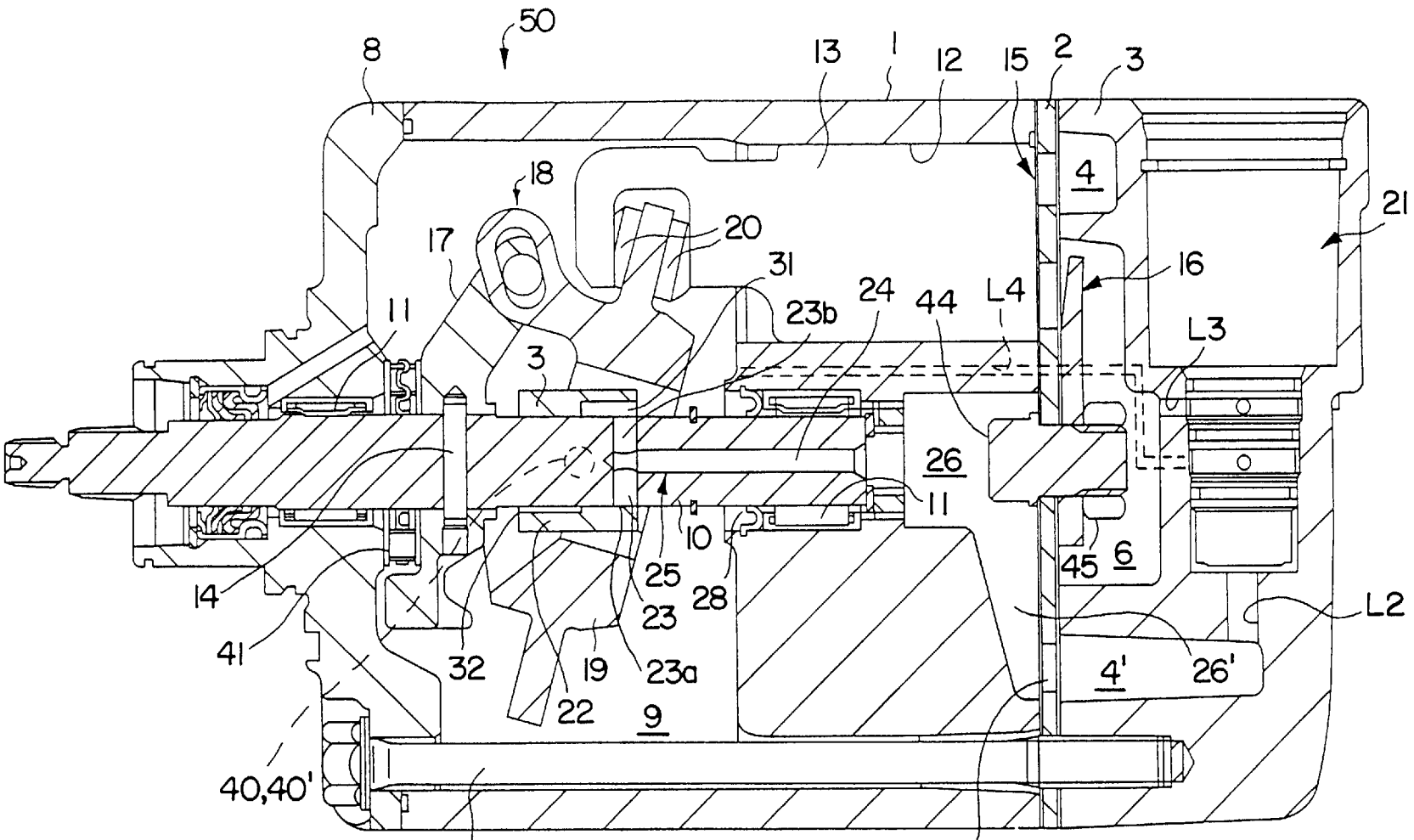
FIG. 3 is a longitudinal cross sectional view of a swash plate-type compressor according to the present invention, in a state of medium tilt angle.
Figure 4:
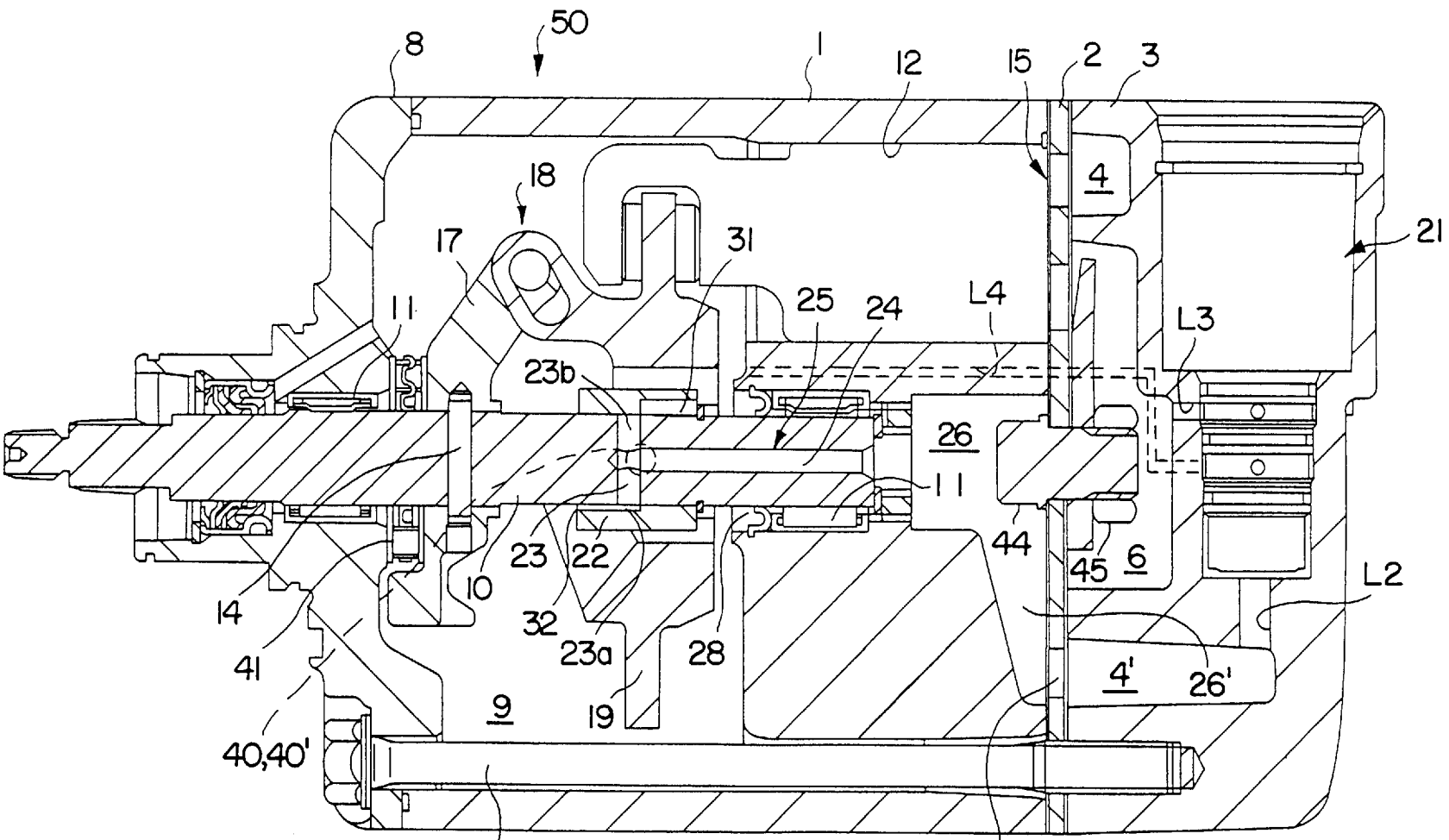
FIG. 4 is a longitudinal cross sectional view of a swash plate-type compressor according to the present invention, in a state of minimum tilt angle.

Referring to FIGS. 2–4, various states of compressor 50, from maximum capacity state to minimum capacity state, are depicted. FIG. 2 shows the maximum capacity state of compressor 50, and also indicates the initiation of capacity reduction. Openings 23*a* and 23*b*, i.e., the entrance to relief passage 25-26-26'-27, are fully opened.

As capacity reduction continues and the tilt angle of swash plate 19 decreases, compressor 50 achieves a state as shown in FIG. 3. The lower (in the figure) wall of center sleeve 22 closes opening 23*a*, but upper groove 31 provides a passage for the refrigerant gas though opening 23*b*. Thus, FIG. 3 shows a state in which the aperture of relief passage 25-26-26'-27 is partially closed.

If capacity reduction continues, compressor 50 achieves the state as shown in FIG. 4. The upper (in the figure) wall of center sleeve 22 closes opening 23*b*, and lower groove 32 affords minimum gas passage through opening 23*a*. This is the state of minimum aperture of relief passage 25-26-26'-27.

As compressor 50 changes from the maximum capacity state to the minimum capacity state, the tilt angle of swash plate 19 decreases, causing the aperture of relief passage 25-26-26'-27, that is, the degree of opening of openings 23*a*, 23*b*, to decrease. In the process of capacity reduction, the introduction of the refrigerant gas via passage L4 to crank chamber 9 is initiated, and the crank chamber pressure consequently increases. This is in contrast with known variable displacement compressor in FIG. 1, where the aperture of the relief passage L1 is always constant, making the rate of increase of the crank chamber pressure within crank chamber 9 almost constant.

Referring again to FIG. 2, the aperture of relief passage 25-26-26'-27 decreases as the capacity of compressor 50 is reduced. The more that the crank chamber pressure in crank chamber 9 increases, the smaller the aperture of relief passage 25-26-26'-27 becomes. Therefore, the crank chamber pressure increases in self-accelerating manner.

Typically, it takes about 5 to 6 seconds for a known compressor to decrease its capacity from maximum to minimum. The compressor according to the present invention will decrease its capacity from maximum to minimum in 1 to 2 seconds.

Additionally, relatively shallow groove 32 is provided to provide a requisite minimum aperture of relief passage 25-26-26-27 to allow the compressor to increase its capacity.

It can be easily understood by those skilled in the art that the present invention can be applied to a wobble plate-type compressor.

This invention has been described in detail in connection with preferred embodiments. These embodiments, however, are merely for example only and the invention is not restricted thereto. It will be understood by those skilled in the art that other variations and modifications can easily be made within the scope of this invention, as defined by the appended claims.

What is claimed is:

1. A compressor comprising:

a suction chamber;

a discharge chamber;

a crank chamber;

a drive shaft having an outer surface, said drive shaft rotated by a vehicle engine;

a swash plate rotatable with said drive shaft within said crank chamber, said swash plate and said drive shaft having a tilt angle between them;

a center sleeve slidably mounted on said drive shaft, a position of said center sleeve responsive to said tilt angle;

a control valve mechanism for controlling said tilt angle by regulating an introduction of a gas from said discharge chamber to said crank chamber; and a relief passage for relieving gas from said crank chamber to said suction chamber, said relief passage comprising:

an axial hole in said drive shaft, said axial hole having an opening at one end of said drive shaft and an end within said drive shaft;

a vertical hole in said drive shaft, said vertical hole having two openings on said surface of said drive shaft and perpendicular to said axial hole, said vertical hole intersecting said axial hole near the end of said axial hole; and a passage in fluid connection with said suction chamber and said opening of said axial hole;

wherein an aperture of said two openings is regulated by the position of said center sleeve.

2. The compressor of claim 1, wherein said center sleeve has a hollow cylindrical shape, said hollow shape having a certain wall thickness.

3. The compressor of claim 2, wherein said center sleeve comprises:

an upper groove on an inner surface of said center sleeve; and a lower groove on the inner surface of said center sleeve;

wherein said upper and lower grooves adjust the aperture of said two openings of said vertical hole.

4. The compressor of claim 3, wherein said two grooves are provided at diagonally opposite positions on said inner surface of said center sleeve.

5. The compressor of claim 1, wherein said aperture of said two openings of said vertical hole is a maximum when said tilt angle is a maximum, and said aperture of said two openings of said vertical hole is a minimum when said tilt angle is a minimum.

6. A compressor comprising:

a suction chamber;

a discharge chamber;

a crank chamber;

a drive shaft having an outer surface, said drive shaft rotated by a vehicle engine;

a swash plate rotatable with said drive shaft within said crank chamber, said swash plate and said drive shaft having a tilt angle between them;

a center sleeve having a hollow cylindrical shape slidably mounted on said drive shaft, a position of said center sleeve responsive to said tilt angle, said hollow shape having a certain wall thickness, said center sleeve comprising:

an upper groove on an inner surface of said center sleeve; and a lower groove on the inner surface of said center sleeve;

a control valve mechanism for controlling said tilt angle by regulating an introduction of a gas from said discharge chamber to said crank chamber; and a relief passage for relieving gas from said crank chamber to said suction chamber, said relief passage comprising:

an axial hole in said drive shaft, said axial hole having an opening at one end of said drive shaft and an end within said drive shaft;

a vertical hole in said drive shaft, said vertical hole having two openings on said surface of said drive shaft and perpendicular to said axial hole, said vertical hole intersecting said axial hole near the end of said axial hole; and a passage in fluid connection with said suction chamber and said opening of said axial hole;

wherein an aperture of said two openings is regulated by the position of said center sleeve, and said upper and lower grooves of said center sleeve adjust the aperture of said two openings of said vertical hole.

7. The compressor of claim 6, wherein said two grooves are provided at diagonally opposite positions on said inner surface of said center sleeve.

8. A compressor comprising:

a suction chamber;

a discharge chamber;

a crank chamber;

a drive shaft having an outer surface, said drive shaft rotated by a vehicle engine;

a swash plate rotatable with said drive shaft within said crank chamber, said swash plate and said drive shaft having a tilt angle between them;

a center sleeve slidably mounted on said drive shaft, a position of said center sleeve responsive to said tilt angle;

a control valve mechanism for controlling said tilt angle by regulating an introduction of a gas from said discharge chamber to said crank chamber; and a relief passage for relieving gas from said crank chamber to said suction chamber, said relief passage comprising:

an axial hole in said drive shaft, said axial hole having an opening at one end of said drive shaft and an end within said drive shaft;

a vertical hole in said drive shaft, said vertical hole having two openings in said surface of said drive shaft and perpendicular to said axial hole, said vertical hole intersecting said axial hole near the end of said axial hole; and a passage in fluid connection with said suction chamber and said opening of said axial hole;

wherein an aperture of said two openings is regulated by the position of said center sleeve, and said aperture of said two openings of said vertical hole is a maximum when said tilt angle is a maximum, and said aperture of said two openings of said vertical hole is a minimum when said tilt angle is a minimum.

* * * * *